US007802863B2

(12) United States Patent
Suzuki

(10) Patent No.: US 7,802,863 B2
(45) Date of Patent: Sep. 28, 2010

(54) INK-JET RECORDING APPARATUS

(75) Inventor: Katsuaki Suzuki, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 502 days.

(21) Appl. No.: 11/940,705

(22) Filed: Nov. 15, 2007

(65) Prior Publication Data

US 2008/0122888 A1 May 29, 2008

(30) Foreign Application Priority Data

Nov. 24, 2006 (JP) ..... 2006-316890

(51) Int. Cl.
*B41J 29/38* (2006.01)

(52) U.S. Cl. ..... 347/10; 347/11; 347/5

(58) Field of Classification Search ..... 347/5, 347/9, 10, 11, 14, 15, 19
See application file for complete search history.

(56) References Cited

U.S. PATENT DOCUMENTS 5,790,139 A * 8/1998 Umeno et al. ..... 347/10
6,830,305 B1 * 12/2004 Takizawa ..... 347/10

FOREIGN PATENT DOCUMENTS

JP 2001-315324 A 11/2001
JP 2002-036568 A 2/2002
JP 2005-041011 A 2/2005

OTHER PUBLICATIONS

Japanese Patent Office, Notice of Reasons for Rejection for Japanese Application No. 2006-316890, mailed Dec. 16, 2008. (Counterpart of above-captioned U.S. Patent Application.) (Partial translation).

* cited by examiner

*Primary Examiner*—Lam S Nguyen
(74) *Attorney, Agent, or Firm*—Baker Botts L.L.P.

(57) ABSTRACT

An ink-jet recording apparatus of the present invention includes one or more ink-jet heads, a drive waveform generation circuit, a plurality of drive waveform selection circuits, and a plurality of drive signal generation circuits. The drive waveform generation circuit generates m different drive waveforms (m is equal to or greater than three). The drive waveform selection circuit selects n drive waveforms (n is smaller than m, and equal to or greater than two) from the m drive waveforms. The drive signal generation circuit selects in every predetermined recording cycle one drive waveform for one nozzle from the n drive waveforms selected by the drive waveform selection circuit, and generates a drive signal based on the drive waveform thus selected. At least one of the n drive waveforms selected by any one of the plurality of drive waveform selection circuits is the same as the drive waveform selected by another one of the drive waveform selection circuits.

6 Claims, 6 Drawing Sheets

FIG. 6

| 10−15 | 15−18 | 18−20 | 20−22 | 22−25 | 25−30 | 30−40 |
|---|---|---|---|---|---|---|

| | S | D | T | LT1 | LT2 | F |
|---|---|---|---|---|---|---|
| C | 1 | 2 | 3 | 4 | 5 | 6 |
| M | 1 | 2 | 3 | 4 | 5 | 6 |
| Y | 1 | 2 | 3 | 4 | 5 | 6 |
| K | 7 | 8 | 9 | 4 | 5 | 6 |
| LC | 10 | 11 | 12 | 4 | 5 | 6 |
| LM | 10 | 11 | 12 | 4 | 5 | 6 |

INK-JET RECORDING APPARATUS

CROSS REFERENCE TO RELATED APPLICATION

The present application claims priority from Japanese Patent Application No. 2006-316890, which was filed on Nov. 24, 2006, the disclosure of which is herein incorporated by reference in its entirety.

BACKGROUND OF THE INVENTION

1. Field of the Invention

The present invention relates to an ink-jet recording apparatus which performs a printing by ejecting ink droplets.

2. Description of Related Art

An ink-jet printer is known which prints an image on a recording paper as a recording medium by ejecting ink droplets to the recording paper. Japanese Patent Laid-Open No. 2002-36568 discloses an ink-jet printer including a recording head which has a passage unit and an actuator. The passage unit is formed with nozzles which eject ink droplets and pressure chambers which communicate with the nozzles. The actuator applies ejection energy to ink contained in the pressure chambers. The ink-jet printer further includes a driver IC which generates a drive signal for driving the actuator. In the above-mentioned patent document, the actuator changes a volume of a pressure chamber and thereby applies pressure to ink contained in a pressure chamber. The actuator has a piezoelectric sheet which extends over a plurality of pressure chambers, a plurality of individual electrodes which are opposed to the respective pressure chambers, and a common electrode which cooperates with the plurality of individual electrodes to sandwich the piezoelectric sheets therebetween. A controller, which is on a higher level than the driver IC, simultaneously outputs a plurality of drive waveforms to the driver IC. Here, each of the plurality of drive waveforms includes one or more pulses, and corresponds to each of a plurality of driving patterns of the actuator. The driver IC selects any one of the plurality of drive waveforms which have been outputted from the controller, generates a drive signal including the selected waveform, and supplies the drive signal to an individual electrode. As a result, a portion of the piezoelectric sheet sandwiched between this individual electrode and the common electrode kept at a predetermined potential is applied with an electric field in a thickness direction, and thus this portion of the piezoelectric sheet deforms. At this time, a volume of the pressure chamber changes to apply pressure (ejection energy) to ink contained in the pressure chamber.

SUMMARY OF THE INVENTION

A color-printable ink-jet printer includes, for example, six ink-jet heads which eject six types of ink droplets, respectively. The six types of ink droplets are different in colors, namely, cyan (C), magenta (M), yellow (Y), black (K), light cyan (LC), and light magenta (LM). The six ink-jet heads do not overlap each other in terms of the color of ink droplets they eject. The different types of ink may differ from one another in their ink characteristics such as viscosity, due to their difference in dye concentration. In such a case, in order to uniformize ink ejection characteristics of a plurality of ink-jet heads which eject different types of ink, it is preferable that a drive signal optimized for each of the plurality of types of ink is supplied to an actuator corresponding to the ink. For this purpose, it is conceivable that, in a controller which is on a higher level than the actuator is, drive waveforms the number of which is equal to the number of driving patterns of the actuator are generated with respect to each of the plurality of types of ink. According to this idea, in a case where the actuator has six driving patterns for example, the higher-level controller generates 36 drive waveforms (six types of ink×6 driving patterns). This increases a circuit scale of a control system, and consequently increases costs of the ink-jet printer.

An object of the present invention is to provide an ink-jet recording apparatus which can uniformize ejection performance relating to a plurality of types of ink while reducing a circuit scale of a control system.

According to an aspect of the present invention, there is provided an ink-jet recording apparatus comprising one or more ink-jet heads, a drive waveform generation circuit, a plurality of drive waveform selection circuits, and a plurality of drive signal generation circuits. Each of the one or more ink-jet heads includes a passage unit and a plurality of ejection energy appliers. The passage unit is formed with a plurality of individual ink passages each extending from an exit of a common ink chamber through a pressure chamber to a nozzle. The plurality of ejection energy appliers apply ejection energy to ink in a plurality of pressure chambers. The drive waveform generation circuit generates m different drive waveforms (m is equal to or greater than three) indicating driving patterns of the ejection energy applier. Each of the plurality of drive waveform selection circuits selects, based on a first section signal, n drive waveforms (n is smaller than m, and equal to or greater than two) from the m drive waveforms generated by the drive waveform generation circuit. At least one of the plurality of drive signal generation circuits is provided for each drive waveform selection circuit, and each of the plurality of drive signal generation circuits selects in every predetermined recording cycle one drive waveform for one nozzle from the n drive waveforms selected by the drive waveform selection circuit based on a second selection signal, and generates a drive signal for driving the ejection energy applier corresponding to the one nozzle based on the drive waveform thus selected. At least one of the n drive waveforms selected by any one of the plurality of drive waveform selection circuits is the same as the drive waveform selected by another one of the drive waveform selection circuits. At least one of the n drive waveforms selected by the drive waveform selection circuit is not selected by another one of the drive waveform selection circuits.

According to the present invention, the n drive waveforms can be selected by each drive waveform selection circuit in consideration of ejection characteristics of the nozzle. As a result, ejection performance with a plurality of types of ink can be uniformized. In addition, each drive waveform selection circuit selects n drive waveforms from the m drive waveforms generated by the drive waveform generation circuit. At this time, at least one of the n drive waveforms selected by any one of the plurality of drive waveform selection circuits is the same as the drive waveform selected by another one of the drive waveform selection circuits. Therefore, at least one of the drive waveforms generated by the drive waveform generation circuit is selected by two or more drive waveform selection circuits. Thus, a circuit scale of a control system can be reduced by adopting such a construction that one drive waveform generation circuit is commonly shared by a plurality of drive waveform selection circuits. In the present invention, at least one of the n drive waveforms selected by the drive waveform selection circuit is not selected by at least another one of the drive waveform selection circuits. Consequently, the n drive waveforms selected by any one of the drive waveform selection circuits are not the same as the n drive waveforms selected by another one of the drive waveform selection circuits.

BRIEF DESCRIPTION OF THE DRAWINGS

Other and further objects, features and advantages of the invention will appear more fully from the following description taken in connection with the accompanying drawings in which:

FIG. 6 shows a configuration of a drive waveform determination table.

DESCRIPTION OF THE PREFERRED EMBODIMENTS

Figure 1:
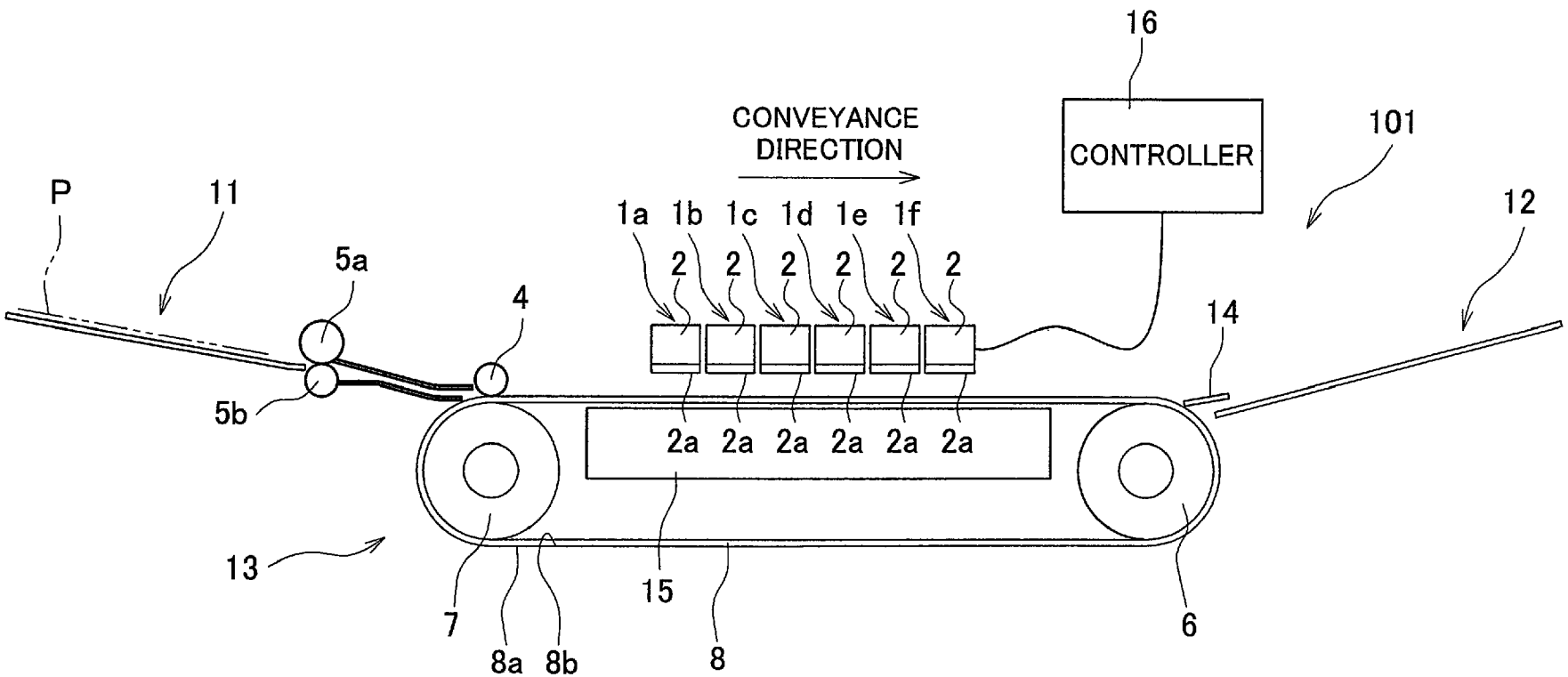
FIG. 1 is a side view of ink-jet heads according to an embodiment of the present invention.

FIG. 1 is a side view of an ink-jet printer according to one preferred embodiment of the present invention. As shown in FIG. 1, an ink-jet printer 101 which is an ink-jet recording apparatus is a color ink-jet printer having six ink-jet heads 1*a*, 1*b*, 1*c*, 1*d*, 1*e*, and 1*f*. The ink-jet printer 101 has a controller 16 which controls operations of respective parts of the ink-jet printer 101. The ink-jet printer 101 includes a paper feed tray 11 and a paper discharge tray 12, which are shown in left and right parts of FIG. 1, respectively.

Formed within the ink-jet printer 101 is a conveyance path through which a paper P which is a recording medium is conveyed from the paper feed tray 11 toward the paper discharge tray 12. A pair of feed rollers 5*a* and 5*b* which pinch and convey a paper are provided immediately downstream of the paper feed tray 11 along the conveyance path. The pair of feed rollers 5*a* and 5*b* send out a paper P from the paper feed tray 11 rightward in FIG. 1. A belt conveyor mechanism 13 is provided in a middle of the conveyor path. The belt conveyor mechanism 13 includes two belt rollers 6 and 7, an endless conveyor belt 8 which are wound on the rollers 6 and 7 so as to be stretched therebetween, and a platen 15 which is disposed within a region enclosed by the conveyor belt 8 so as to be opposed to the ink-jet heads 1*a* to 1*f*. The platen 15 supports the conveyor belt 8 to prevent the conveyor belt 8 from bending down in its region opposed to the ink-jet heads 1*a* to 1*f*. A nip roller 4 is disposed at a position opposed to the belt roller 7. The nip roller 4 presses a paper P, which has been sent out from the paper feed tray 11 by the feed rollers 5*a* and 5*b*, onto an outer circumferential surface 8*a* of the conveyor belt 8.

As the belt roller 6 is rotated by a not-shown conveyor motor, the conveyor belt 8 is driven. Thereby, a paper, which has been pressed by the nip roller 4 onto the outer circumferential surface 8*a* having adhesiveness, is held and conveyed toward the paper discharge tray 12 by the conveyor belt 8. Like this, the conveyor mechanism which conveys the paper P is made up of the conveyor belt 8, the belt rollers 6, 7, and the conveyor motor which rotates the belt roller 6.

A peeling plate 14 is provided immediately downstream of the conveyor belt 8 in the paper conveyance path. The peeling plate 14 peels a paper P, which has been held on the outer circumferential surface 8*a* of the conveyor belt 8, from the outer circumferential surface 8*a*. The paper P thus peeled off is conveyed toward the paper discharge tray 12.

The six ink-jet heads 1*a* to 1*f* are arranged side by side along a conveyance direction of the paper P. Thus, the ink-jet printer 101 is a line-type printer. The six ink-jet heads 1*a* to 1*f* non-overlappingly correspond to six ink colors, namely, cyan, magenta, yellow, black, light cyan, and light magenta, respectively. Each of the ink-jet heads 1*a* to 1*f* has a head main body 2 at its lower end. The head main body 2 has a rectangular parallelepiped shape elongated in a direction perpendicular to the conveyance direction. A bottom face of the head main body 2 serves as an ink ejection face 2*a* which is opposed to the outer circumferential surface 8*a* of the conveyor belt 8. While a paper P being conveyed on the conveyor belt 8 is sequentially passing just under the six head main bodies 2, ink droplets of respective colors are ejected from the ink ejection faces 2*a* toward a print region formed on an upper face of the paper P. Thereby, a desired color image is formed on the paper P. A controller 16 which will be described later performs the above-described operations of paper feeding, image forming, and paper discharging in a smooth and continuous manner.

Figure 2:
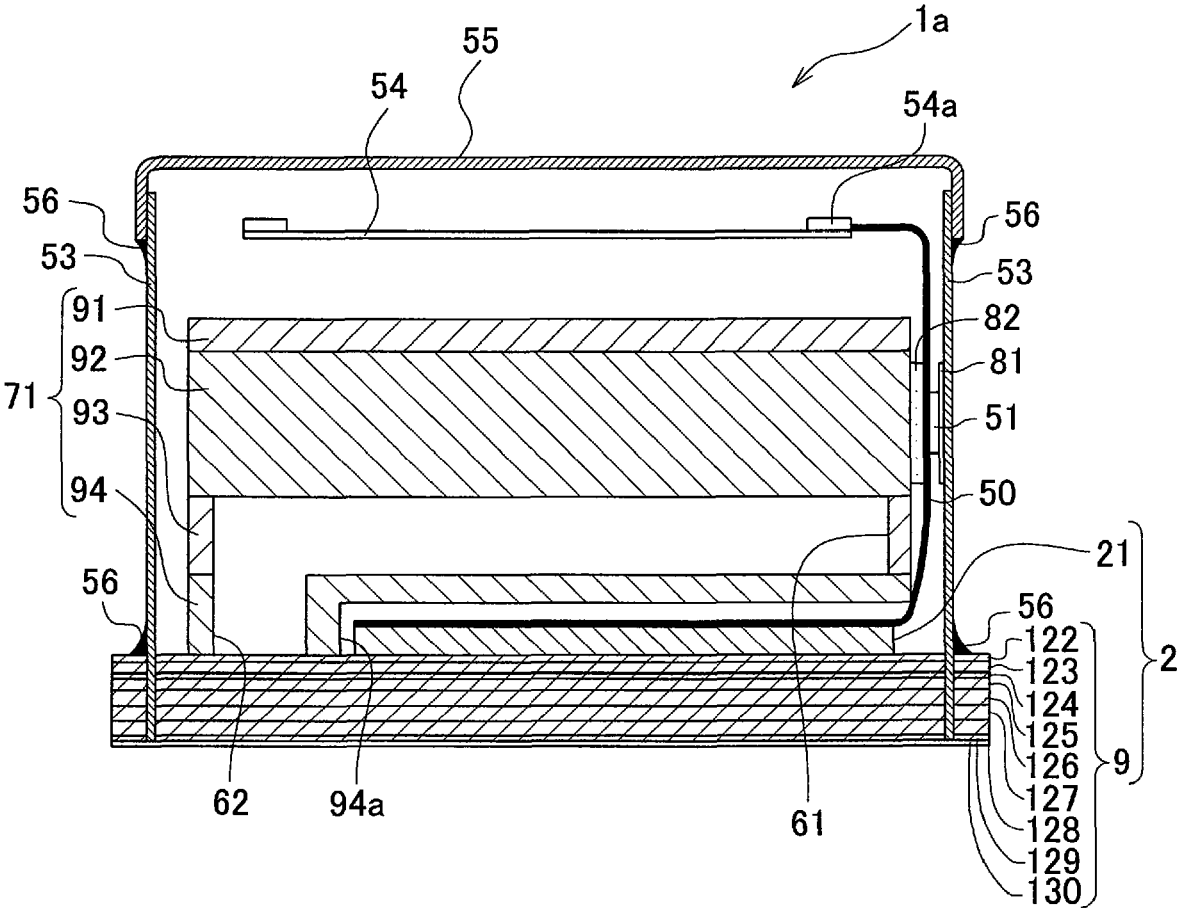
FIG. 2 is a sectional view of the ink-jet head shown in FIG. 1 taken along a width thereof.

Next, with reference to FIG. 2, a detailed description will be given to the ink-jet heads 1*a* to 1*f*. FIG. 2 is a sectional view of the ink-jet head 1*a* taken along a width thereof. The same view also applies to the ink-jet heads 1*b* to 1*f*. As shown in FIG. 2, the ink-jet head 1*a* has a head main body 2, a reservoir unit 71, four COFs (Chip On Film) 50 (only one of which is shown in FIG. 2), a circuit board 54, side covers 53, and a head cover 55. The head main body 2 includes a passage unit 9 and four actuator units 21 (only one of which is shown in FIG. 2). The reservoir unit 71 is disposed on an upper face of the head main body 2, and supplies ink to the head main body 2. The COF 50 is, on its surface, mounted with a driver IC 51 which includes a drive signal generating circuit. The driver IC 51 generates a drive signal for driving a corresponding actuator unit 21. The circuit board 54 is electrically connected to the COF 50. The side covers 53 and the head cover 55 cover the actuator units 21, the reservoir unit 71, the COFs 50, and the circuit board 54, to prevent intrusion of ink from outside.

As shown in FIG. 2, the head main body 2 includes a passage unit 9 and four actuator units 21 fixed to an upper face of the passage unit 9. The passage unit 9 has a layered structure of metal plates 122 to 130. Formed on a lower face of the passage unit 9 is an ink ejection face 2*a* where a plurality of nozzles which eject ink droplets are opened. Also, a not-shown common ink passage to which ink is supplied, and a plurality of individual ink passages each extending from the common ink passage through a pressure chamber to a nozzle are formed within the passage unit 9.

The actuator unit 21 is a continuous flat plate including a plurality of actuators which correspond to respective pressure chambers of the passage unit 9. The actuator unit 21 selectively applies ejection energy to ink contained in the pressure chambers. In this embodiment, the actuator unit 21 is a piezoelectric-type actuator having a piezoelectric sheet which is made of a lead zirconate titanate (PZT)-base ceramic material having ferroelectricity. The piezoelectric sheet is sandwiched between a common electrode and individual electrodes which are opposed to the pressure chambers. The common electrode is, in its region corresponding to every pressure chamber, equally given the ground potential. On the other hand, the individual electrodes are electrically connected to respective terminals of the driver IC 51 through internal wirings of the COF 50, so that a drive signal from the driver IC 51 is selectively inputted to the individual electrodes. That is, in the actuator unit 21, a portion sandwiched between the individual electrode and the pressure chamber act as an individual actuator, and there are a plurality of actuators corresponding to the number of pressure chambers. By inputting a drive signal to an individual electrode, a region of the actuator unit 21 corresponding to this individual electrode deforms to protrude toward a pressure chamber. As a result, pressure or ejection energy is applied to ink contained in the pressure chamber, to generate a pressure wave in the pressure chamber. As the generated pressure wave propagates from the pressure chamber to a nozzle, an ink droplet is ejected from the nozzle.

The reservoir unit 71 is made up of four metal plates 91 to 94 positioned in layers to each other. An ink passage including an ink reservoir 61 and ink outflow passages 62 is formed within the reservoir unit 71. The passage unit 9 is bonded to a lower face of the reservoir unit 71. Thus, the reservoir unit 71 and the passage unit 9 are thermally coupled with each other. The ink passage formed within the reservoir unit 71 communicates with an ink passage formed within the passage unit 9. Ink supplied from a not-shown ink tank is temporarily stored in the ink reservoir 61. The ink stored in the ink reservoir 61 is supplied through the ink outflow passages 62 to the common ink passage of the passage unit 9.

One end of the COF 50 is bonded to an upper face of the actuator unit 21. Thereby, the internal wirings of the COF 50 are electrically connected to the electrodes formed on the upper face of the actuator unit 21. The COF 50 extends from the upper face of the actuator unit 21 upward through a space between the side cover 53 and the reservoir unit 71, and the other end of the COF 50 is connected to the circuit board 54 via a connector 54*a*. The circuit board 54 relays a signal from the controller 16 to the COF 50.

The controller 16 controls the driver IC 51 so as to generate a drive signal for driving the actuator unit 21, as will be described later. The driver IC 51 is biased toward the side cover 53 by a sponge which is adhered to a side face of the reservoir unit 71. The driver IC 52 is in tight contact with an inside face of the side cover 53 with a dissipation sheet 81 sandwiched therebetween. Thereby, the driver IC 52 is thermally coupled with the side cover 53. Consequently, heat of the driver IC 51 is dissipated through the side cover 53 to outside.

The side covers 53 are metallic plate members, and extend upward from both widthwise end portions of the upper face of the passage unit 9. The head cover 55 is mounted over the side covers 53 so as to seal a space above the passage unit 9. Sealing members 56 made of a silicon resin or the like are applied to where the side cover 53 and the passage unit 9 are connected to each other, and where the side cover 53 and the head cover 55 are fitted to each other.

Figure 3:
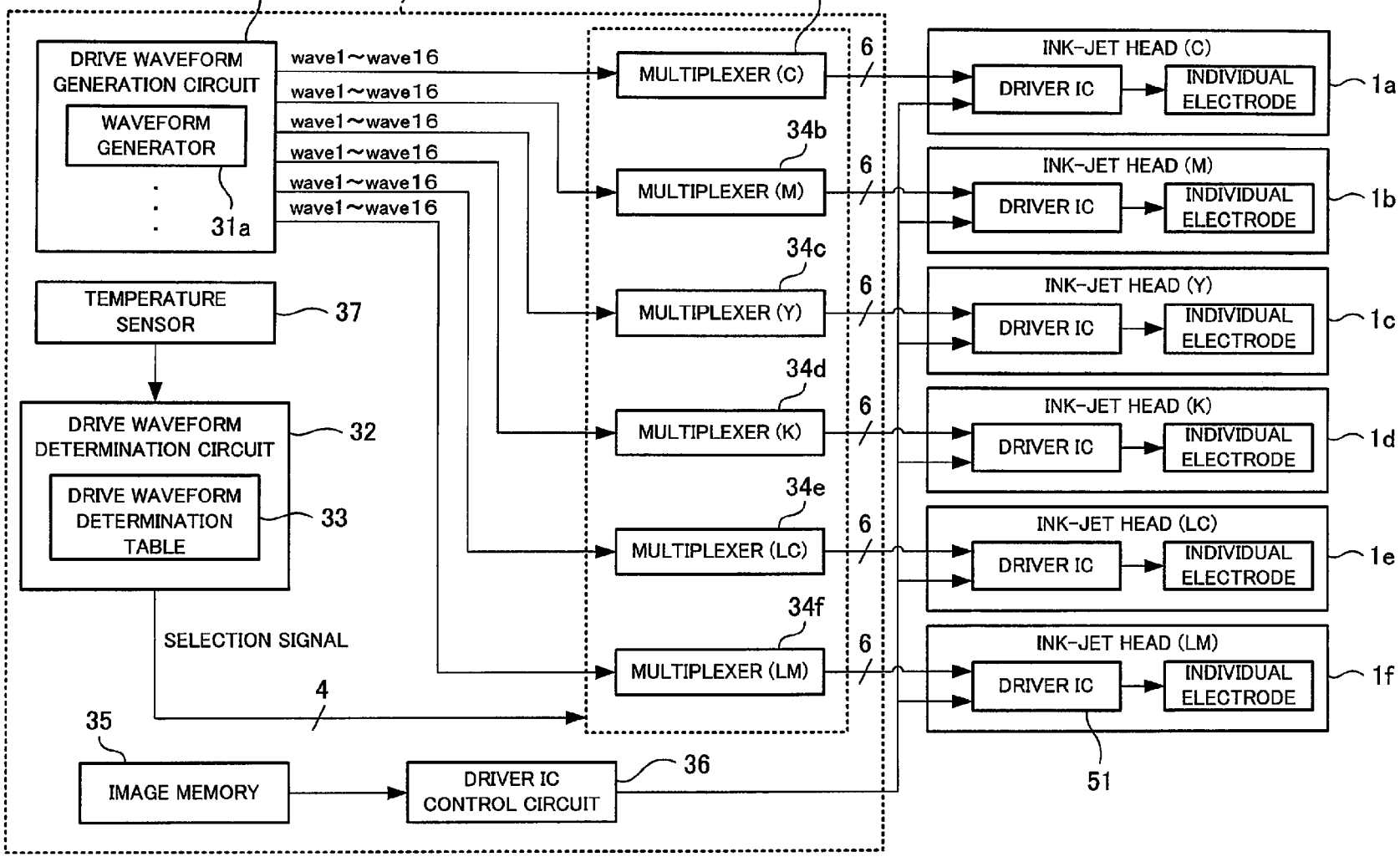
FIG. 3 is a block diagram of an ink-jet printer shown in FIG. 1.

Next, the controller 16 and the driver IC 51 which is mounted on the COF 50 will be described in detail with reference to FIG. 3. FIG. 3 is a block diagram of the ink-jet printer 101. As shown in FIG. 3, the controller 16 includes a drive waveform generation circuit 31, a drive waveform determination circuit 32, six multiplexers 34*a*, 34*b*, 34*c*, 34*d*, 34*e*, and 34*f* which are a drive waveform selection circuit, an image memory 35, a driver IC control circuit 36, and a temperature sensor 37.

Figure 4:
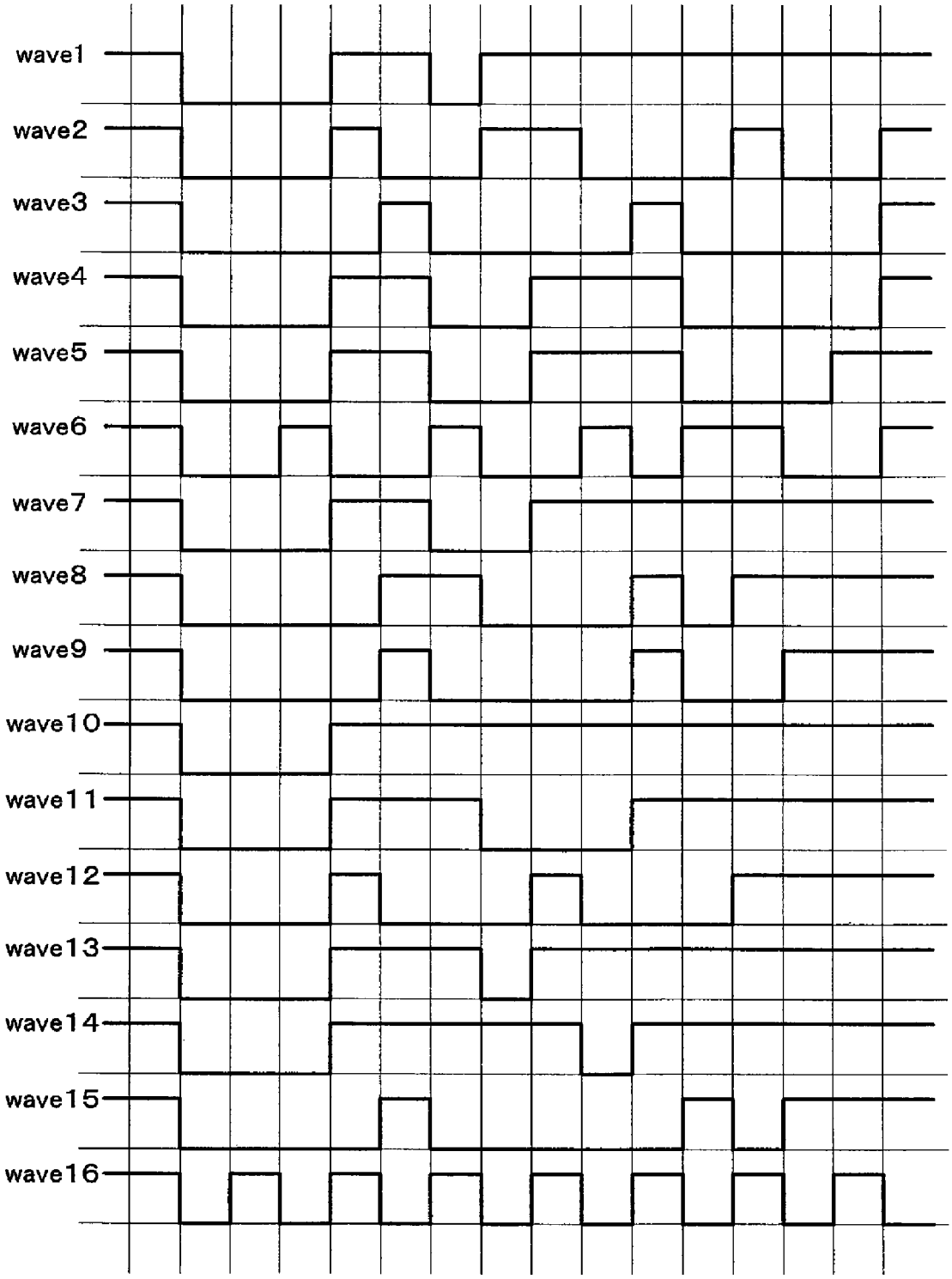
FIG. 4 is a waveform diagram showing an example of drive waveforms which are generated by a drive waveform generation circuit shown in FIG. 3.
Figure 5:
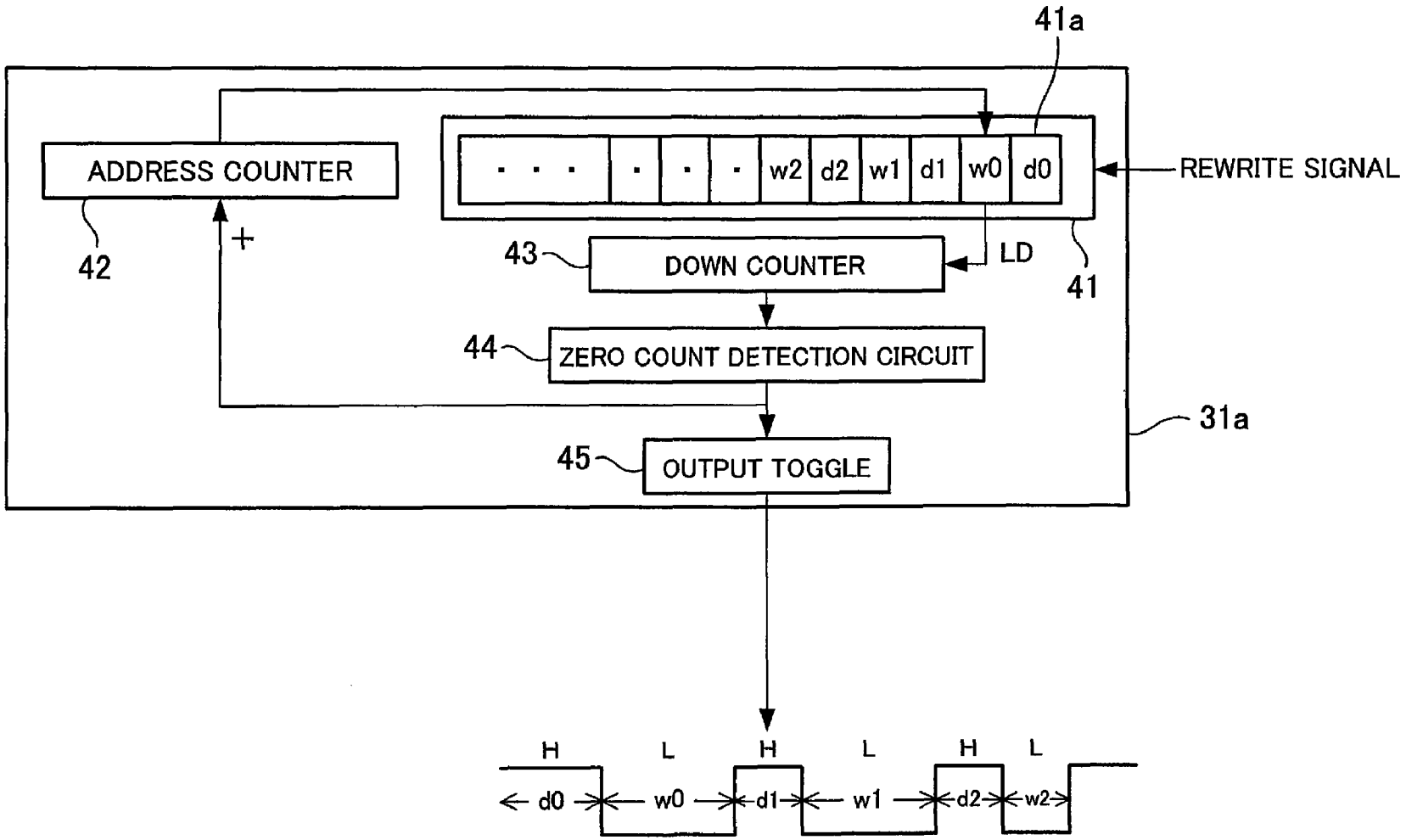
FIG. 5 is a block diagram of a waveform generator shown in FIG. 3.

The drive waveform generation circuit 31 will be described further with reference to FIGS. 4 and 5. FIG. 4 is a waveform diagram showing an example of drive waveforms which are generated by the drive waveform generation circuit 31. FIG. 5 is a block diagram of a waveform generator 31*a*. The drive waveform generation circuit 31 generates sixteen (m) drive waveforms (wave1 to wave16) indicating different driving patterns of the actuator unit 21 as shown in FIG. 4. The drive waveform generation circuit 31 has sixteen waveform generators 31*a* which generate the respective drive waveforms. The sixteen drive waveforms generated by the drive waveform generation circuit 31 are supplied to all of the six multiplexers 34*a*, 34*b*, 34*c*, 34*d*, 34*e*, and 34*f*. As shown in FIG. 5, the waveform generator 31*a* has a waveform pattern memory 41, a down counter 43, a zero count detection circuit 44, an address counter 42, and an output toggle 45. The drive waveform generated by the waveform generator 31*a* is a rectangular pulse train having a HI signal level section and a LOW signal level section alternating with each other as shown in FIG. 4.

The waveform pattern memory 41 has a plurality of registers 41*a*. In the respective registers 41*a*, a time length of each HI signal level section (d0, d1, d2, . . . ) and a time length of each LOW signal level section (w0, w1, w2, . . . ) of the drive waveforms are stored in a time sequence and in an order of addresses of the respective registers 41*a*. The time length stored in the register 41*a* is a clock number relating to a not-shown reference clock. In addition, memory contents of the register 41*a* are rewritable by a rewrite signal given from the outside. The down counter 43 loads (LD) the clock number stored in the register 41*a* which is indicated by the address counter 42, and counts down the loaded clock number based on the reference clock. The zero count detection circuit 44 detects that the counter of the down counter 43 is zero. When detecting that the counter is zero, the zero count detection circuit 44 outputs a detection signal to the output toggle 45 and the address counter 42. The output toggle 45 outputs a drive waveform. Every time a detection signal is outputted from the zero count detection circuit 44, the output toggle 45 switches a signal level of the outputted drive waveform alternatively between HI and LOW. Thereby, a drive waveform including a series of pulses is generated. The address counter 42 indicates which register 41*a* is to be loaded by the down counter 43. Every time a detection signal is outputted from the zero count detection circuit 44, the address counter 42 proceeds to the next register 41*a* to be indicated which is starting from a first address. When a detection signal is outputted from the zero count detection circuit 44 while the address counter 42 is indicating the register 41*a* located in the last address, the address counter 42 then indicates the register 41*a* located in the first address again.

Like this, the signal level of the drive waveform sequentially changes between HI and LOW in accordance with contents stored in the plurality of registers 41*a* of the waveform pattern memory 41. As described above, contents of the register 41*a* are rewritable from the outside. Therefore, by properly rewriting contents of the register 41*a*, it is possible to make the drive waveform generation circuit 31 generate a drive waveform having an arbitrary waveform. Each waveform generator 31*a* consecutively generates and outputs the drive waveform stored in the waveform pattern memory 41. The drive waveform is adjusted in such a manner that one drive waveform is outputted in every printing cycle. Here, the printing cycle means a cycle of ejecting an ink droplet from a nozzle. In other words, the printing cycle means a period of time required for the paper P to be conveyed by a unit distance which corresponds to a printing resolution of an image to be printed on the paper P.

Referring to FIG. 3 again, the temperature sensor 37 detects an internal temperature of the ink-jet printer 101, and a detection result is outputted to the drive waveform determination circuit 32. The drive waveform determination circuit 32 has a drive waveform determination table 33. Based on the detection result from the temperature sensor 37, the drive waveform determination circuit 32 refers to the drive waveform determination table 33 to determine, among sixteen drive waveforms generated by the drive waveform generation circuit 31, six drive waveforms to be supplied to the respective ink-jet heads 1*a* to 1*f*. Further, the drive waveform determination circuit 32 generates a select signal based on this determination, that is, a first selection signal, and outputs the first selection signal to the respective multiplexers 34*a* to 34*f*. The select signal is a 4-bit signal for identifying sixteen drive waveforms. The six drive waveforms are, for example, a drive waveform for ejecting a single ink droplet (S), a drive waveform for ejecting double ink droplets (D), a drive waveform for ejecting triple ink droplets (T), a first drive waveform for ejecting a largest ink droplet (LT1), a second drive waveform for ejecting a largest ink droplet (LT2), a drive waveform for continuous ejection flushing (F).

The drive waveform determination table 33 will be described with reference to FIG. 6. FIG. 6 shows a configuration of the drive waveform determination table 33. As shown in FIG. 6, in the drive waveform determination table 33, each of six types of ink (C, M, Y, K, LC, and LM) is associated with six identification codes (among "1" to "16" corresponding to wave1 to wave16) which indicate different drive waveforms (S, D, T, LT1, LT2, F), with respect to each of seven temperature ranges (10-15 degrees C., 15-18 degrees C., 18-20 degrees C., 20-22 degrees C., 22-25 degrees C., 25-30 degrees C., and 30-40 degrees C.) which are ranges of the internal temperature of the ink-jet printer 10. Neighboring ones of the seven temperature ranges are continuous with each other and do not overlap each other. Ink ejection characteristics of the ink-jet heads 1*a* to 1*f* change depending on a dye concentration of ink to be ejected. Therefore, table contents stored in the drive waveform determination table 33 are determined in advance in such a manner that an optimum drive waveform is supplied to the ink-jet heads 1*a* to 1*f* based on a dye concentration of an ink droplet to be ejected from the ink-jet heads 1*a* to 1*f*.

For example, three types of ink, cyan, magenta, and yellow, have similar dye concentrations, and two types of ink, light cyan and light magenta, have similar dye concentrations. Accordingly, the drive waveform determination table 33 is configured in such a manner that the same, six drive waveforms are supplied to the three ink-jet heads 1*a*, 1*b*, and 1*c* which eject cyan ink, magenta ink, and yellow ink, respectively, while the same, six drive waveforms are supplied to the two ink-jet heads 1*e* and 1*f* which eject light cyan ink and light magenta ink, respectively. The drive waveform is optimized based on a dye concentration of each ink. Therefore, in the drive waveform determination table 33, the same drive waveforms are adopted for LT1, LT2, and F while different drive waveforms are adopted for S, D, and T. The drive waveform determination circuit 32 refers to the drive waveform determination table 33 with respect to a temperature range corresponding to a detection result from the temperature sensor 37. Thereby, the drive waveform determination circuit 32 determines six drive waveforms to be supplied to the ink-jet heads 1*a* to 1*f*, respectively.

Referring to FIG. 3 again, the six multiplexers 34*a* to 34*f* are provided corresponding to types of ink (cyan (C), yellow (Y), magenta (M), black (K), light cyan (LC), and light magenta (LM)), respectively. Based on a select signal supplied from the drive waveform determination circuit 32, each of the multiplexers 34*a* to 34*f* selects six (n) drive waveforms from sixteen drive waveforms generated by the drive waveform generation circuit 31, and supplies the selected six drive waveforms to the corresponding ink-jet heads 1*a* to 1*f*, respectively. As described above, a select signal inputted from the drive waveform determination circuit 32 is generated based on the drive waveform determination table 33. Therefore, the three multiplexers 34*a*, 34*b*, and 34*c* select the same, six drive waveforms, and the two multiplexers 34*e* and 34*f* select the same, six drive waveforms. In this embodiment, like this, the six drive waveforms can be selected by the six multiplexers 34*a* to 34*f* in consideration of ejection characteristics of the nozzle. As a result, ejection performance with the six types of ink can be uniformized.

Among the six drive waveforms selected by any one of the multiplexers 34*a* to 34*f*, at least one drive waveform is not selected by another one of the multiplexers 34*a* to 34*f*. That is, the six drive waveforms selected by any one of the multiplexers 34*a* to 34*f* are not the same as the six drive waveforms selected by another one of the multiplexers 34*a* to 34*f*. This makes it necessary to provide a plurality of multiplexers 34*a* to 34*f*. In this embodiment, the same, six drive waveforms are supplied to the three ink-jet heads 1*a*, 1*b*, and 1*c*. Therefore, these three heads may share one multiplexer while the two ink-jet heads 1*e* and 1*f* share another one multiplexer. In this embodiment, it suffices that at least three multiplexers are provided.

The image memory 35 stores therein one or more to-be-printed image data files which are transferred from a higher-level device not shown. By a command from a host computer for example, the driver IC control circuit 36 outputs a control signal including a second selection signal, to thereby control the driver ICs 51 of the respective ink-jet heads 1*a* to 1*f* so as to form on a paper P an image corresponding to the image data file stored in the image memory 35.

As described above, each of the ink-jet heads 1*a* to if has four driver ICs 51 which is the same in number as the actuator units 21. In other words, four driver ICs 51 are provided for each of the multiplexers 34*a* to 34*f*. (In FIG. 3, for convenience, only one driver IC 51 is illustrated for each of the ink-jet heads 1*a* to 1*f*.) Based on a control signal inputted from the driver IC control circuit 36, in every printing cycle, the driver IC 51 selects one drive waveform for one nozzle (not shown) from the six drive waveforms selected by each of the multiplexers 34*a* to 34*f*. Then, based on the drive waveform thus selected, the driver IC 51 generates a drive signal to be supplied to an individual electrode corresponding to this nozzle. The drive signal is the drive waveform being raised to a predetermined voltage. Due to the drive signal, the actuator unit 21 is driven, and an ink droplet based on the image data file is ejected from the nozzle.

In the above-described embodiment, each of the multiplexers 34*a* to 34*f* supplies to the driver IC 51 six drive waveforms selected from sixteen drive waveforms which have been generated by the drive waveform generation circuit 31. At this time, the three multiplexers 34*a*, 34*b*, and 34*c* supply the same, six drive waveforms to the three ink-jet heads 1*a*, 1*b*, and 1*c*. That is, the six drive waveforms are commonly shared by the three ink-jet heads 1*a*, 1*b*, and 1*c*. In addition, the two multiplexers 34*e* and 34*f* supply the same, six drive waveforms to the two ink-jet heads 1*e* and 1*f*, respectively. That is, the six drive waveforms are commonly shared by the two ink-jet heads 1*e* and 1*f*. Besides, with respect to any of the six types of ink, the first drive waveform for ejecting a largest ink droplet (LT1), the second drive waveform for ejecting a largest ink droplet (LT2), and the drive waveform for continuous ejection flushing (F), which are selected by the six multiplexers 34*a* to 34*f* when the temperature range is 15 to 18 degrees C., are indicated by "4", "5", and "6", respectively.

In this embodiment, like this, the six drive waveforms can be selected by the six multiplexers 34*a* to 34*f* in consideration of ejection characteristics of the nozzle. As a result, ejection performance with the six types of ink can be uniformized. In addition, among the six drive waveforms selected by any one of the six multiplexers 34*a* to 34*f* which correspond to six different types of ink, at least one drive waveform is the same as the drive waveform selected by another one of the multiplexers 34*a* to 34*f*. Accordingly, at least one drive waveform generated by the drive waveform generation circuit 31 is selected by two or more multiplexers. In this construction, one drive waveform generation circuit 31 is commonly shared by the six multiplexers 34*a* to 34*f*, and therefore a circuit scale of a control system can be reduced. To be more specific, the number of waveform generators 31*a* included in the drive waveform generation circuit 31 can be reduced. This leads to reduction in costs of the ink-jet printer 101. In this embodiment, further, among the six drive waveforms selected by any one of the multiplexers 34*a* to 34*f*, at least one drive waveform is not selected by at least another one of the multiplexers 34*a* to 34*f*. Therefore, the n drive waveforms selected by any one of the multiplexers 34*a* to 34*f* are not the same as the n drive waveforms selected by another one of the multiplexers 34*a* to 34*f*.

Moreover, the select signal outputted from the drive waveform determination circuit 32 is generated based on the drive waveform determination table 33 which is adapted to supply an optimum drive waveform to each driver IC 51. Therefore, the select signal can be quickly generated. In addition, ink ejection characteristics of the ink-jet heads 1*a* to 1*f* can be improved. Further, a drive waveform to be outputted to each driver IC 51 can be appropriately changed by changing contents of the drive waveform determination table 33, which is an easy way.

In this embodiment, in the drive waveform determination table 33, each of the six types of ink is associated with six identification codes with respect to each of the seven temperature ranges. The drive waveform determination circuit 32 determines a drive waveform to be selected, based on the drive waveform determination table 33 and a detection result from the temperature sensor 37. Therefore, temperature characteristics of the ink-jet heads 1*a* to 1*f* are improved.

In addition, since the drive waveform determination table 33 is set based on a dye concentration of an ink droplet ejected from each of the ink-jet heads 1*a* to 1*f*, ink ejection performance of the ink-jet heads 1*a* to 1*f* is improved. The drive waveform determination table 33 may be set in consideration of ink characteristics other than a dye concentration of an ink droplet, inherent characteristics of each of the ink-jet heads 1*a* to 1*f*, and the like.

Further, since the waveform generator 31*a* of the drive waveform generation circuit 31 is able to generate a drive waveform having an arbitrary waveform, ink-jet heads having different ink ejection characteristics can easily be dealt with.

The multiplexers 34*a* to 34*f* are provided corresponding to different types of ink ejected from the six ink-jet heads, respectively. Therefore, it is possible to supply a drive waveform most suitable for a type of ink to be ejected. Consequently, ink ejection performance is further improved.

In the following, modifications of the above-described embodiment will be described. In the above-described embodiment, the drive waveform generation circuit 31 generates sixteen drive waveforms, and each of the multiplexers 34*a* to 34*f* selects six drive waveforms from the sixteen drive waveforms generated by the drive waveform generation circuit 31. However, a drive waveform generation circuit may generate an arbitrary number of drive waveforms, as long as the number of drive waveforms is acceptable in terms of a circuit scale of a control system. Also, the multiplexer may select one to five drive waveforms, or seven or more drive waveforms.

In the above-described embodiment, moreover, the drive waveform determination circuit 32 refers to the drive waveform determination table 33 to determine six drive waveforms to be supplied to each driver IC 51, and the drive waveform determination circuit 32 generates and outputs a select signal. However, the drive waveform determination circuit 32 may generate a select signal without reference to the drive waveform determination table 33. For example, a select signal may be generated based on a command from the outside such as a host computer.

In the above-described embodiment, in addition, the drive waveform determination circuit 32 determines six drive waveforms to be supplied to each driver IC 51 based on a detection result from the temperature sensor 37. However, six drive waveforms to be supplied to each driver IC 51 may be determined irrespective of a detection result from the temperature sensor 37.

In the above-described embodiment, in addition, the drive waveform generation circuit 31 includes the waveform generator 31*a* which can generate a drive waveform having an arbitrary waveform. However, a waveform generator may generate only a predetermined drive waveform.

In the above-described embodiment, further, the multiplexers 34*a* to 34*f* are placed within the controller 16. However, the multiplexers 34*a* to 34*f* may be placed within the corresponding ink-jet heads 1*a* to 1*f*.

In the above-described embodiment, further, one of the multiplexers 34*a* to 34*f* supplies a drive waveform to one of the ink-jet heads 1*a* to 1*f*, because each of the ink-jet heads 1*a* to if ejects ink droplets of a single color. However, it may be possible that an ink-jet head ejects droplets of a plurality of colors and is supplied with drive waveforms from a plurality of multiplexers the number of which is equal to the number of ink colors.

In the above-described embodiment, further, the ink-jet printer 101 includes six ink-jet heads 1*a* to 1*f*. However, an ink-jet printer may include one to five ink-jet heads, or seven or more ink-jet heads. In the above-described embodiment, further, an actuator unit using a piezoelectric element is taken as an example of an ejection energy applicator. However, the ejection energy applicator may be a thermal-type one.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

one or more ink-jet heads each including a passage unit and a plurality of ejection energy appliers, the passage unit being formed with a plurality of individual ink passages each extending from an exit of a common ink chamber through a pressure chamber to a nozzle, the plurality of ejection energy appliers applying ejection energy to ink in a plurality of pressure chambers;

a drive waveform generation circuit which generates m different drive waveforms (m is equal to or greater than three) indicating driving patterns of the ejection energy applier;

a plurality of drive waveform selection circuits each of which selects, based on a first section signal, n drive waveforms (n is smaller than m, and equal to or greater than two) from the m drive waveforms generated by the drive waveform generation circuit; and a plurality of drive signal generation circuits at least one of which is provided for each drive waveform selection circuit, and each of which selects in every predetermined recording cycle one drive waveform for one nozzle from the n drive waveforms selected by the drive waveform selection circuit based on a second selection signal, and generates a drive signal for driving the ejection energy applier corresponding to the one nozzle based on the drive waveform thus selected, wherein:

at least one of the n drive waveforms selected by any one of the plurality of drive waveform selection circuits is the same as the drive waveform selected by another one of the drive waveform selection circuits; and at least one of the n drive waveforms selected by the drive waveform selection circuit is not selected by another one of the drive waveform selection circuits.

2. The ink-jet recording apparatus according to claim 1, further comprising a table memory which stores therein a table in which each of a plurality of types of ink is associated with n identification codes indicating different drive waveforms, wherein the first selection signal is generated based on the table stored in the table memory.

3. The ink-jet recording apparatus according to claim 2, wherein, in the table stored in the table memory, each of a plurality of types of ink is associated with n identification codes with respect to each of a plurality of temperature ranges neighboring ones of which are continuous with each other and do not overlap each other.

4. The ink-jet recording apparatus according to claim 2, wherein association between the ink and the n identification codes in the table is based on a dye concentration of the ink.

5. The ink-jet recording apparatus according to claim 1, wherein the drive waveform generation circuit can change the drive waveform to be generated.

6. The ink-jet recording apparatus according to claim 1, wherein the drive waveform selection circuit is provided corresponding to each of different types of ink to be ejected from the one or more ink-jet heads.

* * * * *